US007455630B2

(12) United States Patent
Sato

(10) Patent No.: US 7,455,630 B2
(45) Date of Patent: Nov. 25, 2008

(54) MUSCLE DEVELOPMENT DEVICE

(75) Inventor: Yoshiaki Sato, Tokyo (JP)

(73) Assignee: Sato Sports Plaza Co., Ltd., Tokyo (JP)

( * ) Notice: Subject to any disclaimer, the term of this patent is extended or adjusted under 35 U.S.C. 154(b) by 29 days.

(21) Appl. No.: 10/560,578

(22) PCT Filed: Jun. 8, 2004

(86) PCT No.: PCT/JP2004/008295

§ 371 (c)(1),
(2), (4) Date: Dec. 13, 2005

(87) PCT Pub. No.: WO2004/110564

PCT Pub. Date: Dec. 23, 2004

(65) Prior Publication Data

US 2006/0142128 A1 Jun. 29, 2006

(30) Foreign Application Priority Data

Jun. 13, 2003 (JP) ..... 2003-169267

(51) Int. Cl.
*A63B 21/008* (2006.01)
*A61F 13/00* (2006.01)

(52) U.S. Cl. ..... 482/111; 602/62

(58) Field of Classification Search ..... 482/121–129; 602/62–65, 74

See application file for complete search history.

(56) References Cited

U.S. PATENT DOCUMENTS 1,658,381 A 2/1928 Kilstrom (Continued)

FOREIGN PATENT DOCUMENTS

EP 0 030 705 6/1981

(Continued)

OTHER PUBLICATIONS

English Language Abstracts of JP 10-85361A, JP63-43501U, JP2670421B and JP2796276B.

(Continued)

*Primary Examiner*—Fenn C Mathew
(74) *Attorney, Agent, or Firm*—Michael Bednarek; Paul, Hastings, Janofsky & Walker LLP

(57) ABSTRACT

To provide a muscle development device wherein a sufficient pressure can be applied to every part of the limb intended to be compressed, even under the influence of muscle movements.

To provide a muscle development device comprising: a hallow tight fitting band having a tube and a limiter plate 6 provided therein; and fastening means for use in keeping a length of the tight fitting band in a loop having a desired size, the muscle development device being used to develop muscles of a limb while restricting the blood flow therethrough by means of applying, with the tight fitting band being rest on muscles of a predetermined compressed range of the limb and the tight fitting band being fastened with the fastening means to have a desired size, a predetermined pressure to the limb around which the tight fitting band is wrapped, the pressure being produced by introducing air to the tube. The limiter plate 6 has grooves 6*a* formed therein in order to limit the direction towards which the tube is allowed to inflate as the tube is filled with air, to against the muscles as determined with the tight fitting band being rest on the muscles.

14 Claims, 5 Drawing Sheets

U.S. PATENT DOCUMENTS 6,149,618 A 11/2000 Sato

FOREIGN PATENT DOCUMENTS

| | | | |
|---|---|---|---|
| EP | 0 247 715 | | 12/1987 |
| EP | 247715 | A1 * | 12/1987 |
| JP | 63-43501 | | 3/1988 |
| JP | 07-144027 | | 6/1995 |
| JP | 10-085361 | | 4/1998 |
| JP | 10085361 | A * | 4/1998 |
| JP | 11-299749 | | 11/1999 |

OTHER PUBLICATIONS

Russian Office Action Dated Jul. 3, 2007 and English Language Translation Thereof.

* cited by examiner

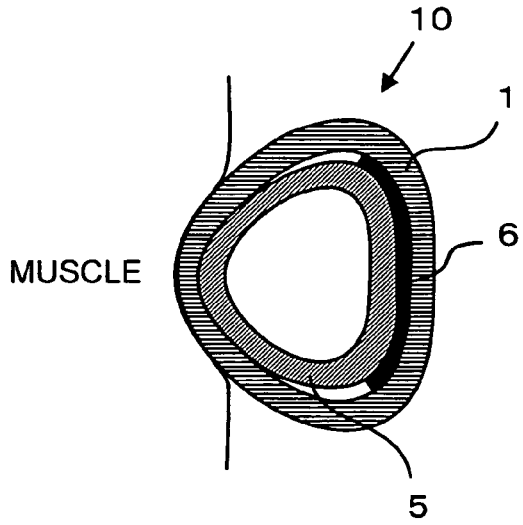
FIG. 2
FIG. 3A
FIG. 3B
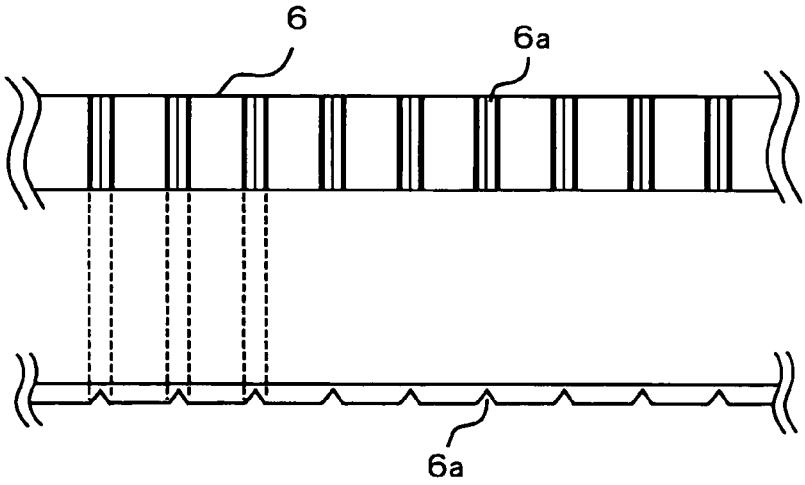

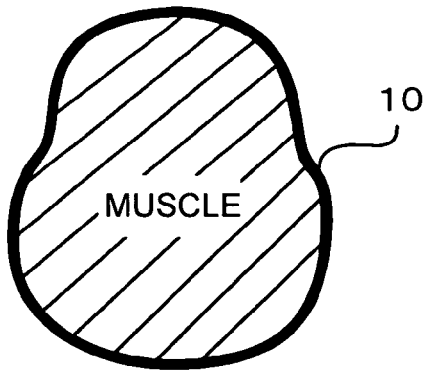
FIG. 6
FIG. 7A
FIG. 7B
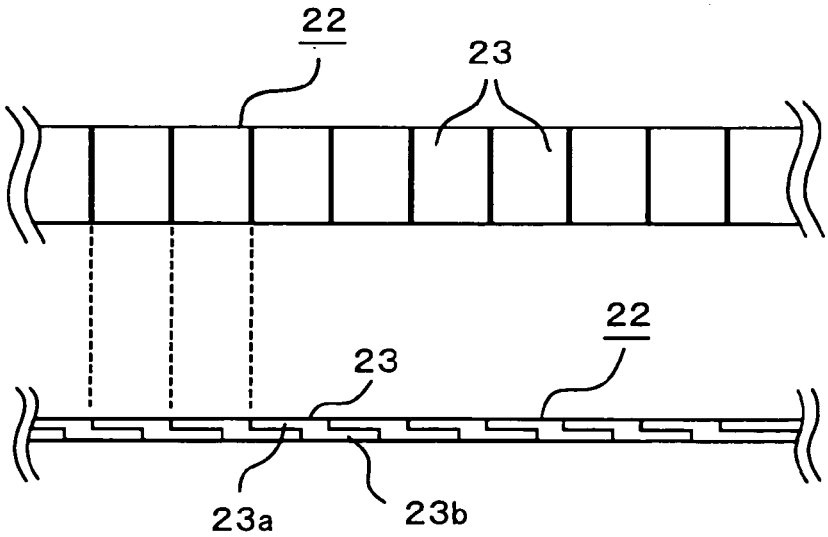

MUSCLE DEVELOPMENT DEVICE

TECHNICAL FIELD

The present invention relates to a muscle development device for the muscle development. More particularly, the present invention relates to a muscle development device suitable for a pressure muscle development method that allows healthy people as well as people having motor abnormalities to develop their muscles in an effective manner.

BACKGROUND OF THE INVENTION

The present inventor has conducted studies for some time in order to work out a muscle development method for easy, safe, and effective muscle development, and put together the accomplishments into a patent application having Japanese Patent Application No. 5-313949, which has been granted as Japanese Patent No. 2670421.

The muscle development method according to the subject patent, which involves the application of pressure, is a distinctive non-conventional one called a "Pressure Muscle Development Method". This muscle development method is based on the following theoretical concept.

Muscles are composed of slow-twitch muscle fibers and fast-twitch muscle fibers. Slow-twitch muscle fibers are limited in their potential for growth. Accordingly, it is necessary to recruit fast-twitch muscle fibers of the slow- and fast-twitch muscle fibers in order to develop muscles. Recruitment of fast-twitch muscle fibers causes lactic acid buildup in the muscles, which triggers secretion of growth hormone from the pituitary. The growth hormone has effects of, for example, promoting muscle growth and shedding body fat. This means that recruitment of fast-twitch muscle fibers results in development of fast-twitch muscle fibers and, in turn, the entire muscles.

Slow-twitch muscle fibers and fast-twitch muscle fibers are different from each other in terms of the following. Slow-twitch muscle fibers use oxygen for energy and are recruited for low-intensity activities. Fast-twitch muscle fibers provide for activities regardless of whether or not oxygen is present. They are recruited after the slow-twitch muscle fibers for highly intense activities. Therefore, it is necessary to cause the earlier recruited slow-twitch muscle fibers to be exhausted soon in order to recruit fast-twitch muscle fibers.

Conventional muscle development methods use exercises with, for example, a barbell to cause the slow-twitch muscle fibers to be exhausted first, and then to recruit the fast-twitch muscle fibers. This recruitment of the fast-twitch muscle fibers requires a significant amount of exercises, is time-consuming, and tends to increase the burden on muscles and joints.

On the other hand, doing muscle exercises while restricting the blood flow through certain muscles by the application of pressure reduces the amount of oxygen carried to the muscles. The slow-twitch muscle fibers, which require oxygen for energy, are thus exhausted in a short period of time. Muscle exercises with blood-flow restriction by application of pressure will result in recruitment of the fast-twitch muscle fibers without needing a large amount of exercises.

In addition, restriction of the blood flow by application of pressure makes the lactic acid built up in the muscles less likely to be removed from the muscles. Thus, the muscle lactic acid level is more likely to rise and a much larger amount of growth hormone is secreted, as compared with the case where the blood flow is unrestricted.

Based on this theoretical concept, restriction of muscle blood flow can provide significant development of the muscles.

The muscle development method according to the aforementioned patent is premised on the theoretical concept of muscle development by the restriction of blood flow. More specifically. a compression pressure for the blood flow restriction is applied to a range near the muscles that you want to develop and closer to the heart, i.e., a proximal region near those muscles. The compression pressure is controlled to put an appropriate stress attributed to blood flow decrease on the muscles, thereby causing muscle fatigue. Thus, effective muscle development is achieved.

This muscle development method features muscle development without any exercises because it involves developing muscles by putting a stress attributed to blood flow decrease on the muscles. In addition, this muscle development method can compensate for a total amount of stress that is placed on the muscles by putting a stress attributed to reduced blood flow on the muscles. When combined with some exercises, the method advantageously reduces an exercise-related stress as compared with conventional methods. This advantage brings about some effects: the possibility of incurring damages to the joints or muscles can be reduced and the period of training can be reduced, as a result of decrease in amount of muscle exercises.

The implementation of this muscle development method requires a muscle development device that can restrict the blood flow through the muscles that you want to develop and can provide accurate control of a compression force being applied to the muscles.

An example of devices that can be used for the restriction of blood flow through muscles includes a tight fitting device which restricts the blood flow with a compression force produced with a belt, as disclosed by the present inventor in the aforementioned Japanese Patent Application No. 5-313949.

This tight fitting device has an advantage of being able to be narrowed, which makes it possible to fit the device exactly around an appropriate range on the muscles through which the blood flow is intended to be restricted. However, it is difficult to determine the exact measure of a compression pressure applied to the muscles. Having the exact measure of the compression pressure available would cause a nuisance of somewhat high costs of manufacture.

The present inventor has made studies for a muscle development device that overcomes the aforementioned problems.

In the course of these studies, the present inventor made an invention relating to a muscle development device as disclosed in Japanese Patent Application No. 8-248317. This muscle development device comprises a tight fitting band having a rubber-made tube provided therein. It comprises an flat piece that limits the direction towards which the tube is allowed to inflate, to against the muscles (inwards; hereinafter, the side of the tight fitting band facing to muscles may be referred to as the "inner side"). This invention was devised in order to overcome the following drawback. When the air is introduced into it for the application of pressure, the tube inflates in a direction away from the muscles (outwards; hereinafter, the side of the tight fitting band not facing to muscles may be referred to as the "outer side"). The pressure produced by the inflation of the tube would disadvantageously be directed outwards rather than being applied to the muscles well, resulting in a failure of application of an appropriate compression force to the muscles.

The muscle development device according to the subject invention uses the aforementioned flat piece that makes it possible to limit the direction towards which the tube is allowed to inflate, to inward. The exact measure of a compression pressure can be determined during the use of the muscle development device. This significantly contributes to the widespread use of the muscle development method by the restriction of the blood flow.

However, such a muscle development device also has a challenge to be solved. More specifically, this muscle development device uses a plate-shaped flat piece. When this flat piece is a single piece of plate, it "bridges" between the ups of undulating muscles as shown in FIG. 10. There is a gap between the muscles and a tight fitting band 101, and a portion thereof does not contact with the surface of the muscles. This would sometimes give rise to uneven compression by the pressure and possible unavailability of uniform pressure to the limb intended to be compressed.

An object of the present invention is to improve the configuration of the flat plate and provide a muscle development device wherein a sufficient pressure can be applied to every part of the limb intended to be compressed, even under the influence of muscle movements.

SUMMARY OF THE INVENTION

In order to achieve the aforementioned objects, the present invention provides a muscle development device comprising: a hollow tight fitting band having a tube therein; and fastening means for keeping a length of the tight fitting band in a loop having a desired size, the muscle development device being used to develop muscles of a limb while restricting the blood flow therethrough by means of applying, with said tight fitting band being rest on muscles of a predetermined compressed range of said limb and said tight fitting band being fastened with said fastening means to have a desired size, a predetermined pressure to said limb around which said tight fitting band is wrapped, the pressure being produced by introducing air to said tube, said tight fitting band having a limiter plate therein, the limiter plate in limiting the direction towards which said tube is allowed to inflate as said tube is filled with air, to against the muscles as determined with said tight fitting band being rest on the muscles, said limiter plate being adapted to flexibly move in a curve by means of grooves provided in the surface thereof against said tube in a direction not parallel to the lengthwise direction of said tight fitting band at a predetermined distance along the length of said tight fitting band.

As described above, the muscle development device according to the present invention uses the limiter plate as the means to limit the direction towards which said tube is allowed to inflate as said tube is filled with air, to against the muscles as determined with said tight fitting band being rest on the muscles, the limiter plate being adapted to flexibly move in a curve by means of grooves provided in the surface thereof against said tube in a direction not parallel to the lengthwise direction of said tight fitting band at a predetermined distance along the length of said tight fitting band.

The limiter plate is adapted to flexibly move in a curve by means of the aforementioned grooves formed therein. Such limit plate can bend at the grooves when the tight fitting band having the limiter plate is rest on muscles. Thus, it can more easily hold the up-and-down surface of complex moving muscles in closer contact with it than the limiter plate of a mere plate-like object can do. Therefore, a sufficient pressure can be applied to every part of the limb intended to be compressed, even under the influence of muscle movements.

Said grooves may have any size as long as they are provided in a direction not parallel to the lengthwise direction of said tight fitting band at a predetermined distance along the length of said tight fitting band and allow said limit plate to bend in a flexible manner. For example, their shape may be a V-shape or a semi-circular shape in cross section.

The requirement for these grooves is that they are provided in a direction not parallel to the lengthwise direction of said tight fitting band. They may be provided in the direction perpendicular to the lengthwise direction. The adjacent grooves may be aligned in parallel.

The predetermined distance may be, for example, 0.5 cm to 1.5 cm. The grooves may be arranged at a fixed distance or not.

Said limiter plate having the aforementioned grooves may be made of any of the suitable materials that can withstand the pressure from said tube. It should be noted that the limit plate is provided within the tight fitting band and is rest on muscles along with the tight fitting band, so that flexibility to such a degree that allows it is required. Specifically, the limiter plate may be made of a resin such as vinyl chloride, polypropylene, and polyester.

In addition, the present invention provides a muscle development device as follows.

More specifically, it is a muscle development device comprising: a hollow tight fitting band having a tube therein; and fastening means keeping a length of the tight fitting band in a loop having a desired size, the muscle development device being used to develop muscles of a limb while restricting the blood flow therethrough by means of applying, with said tight fitting band being rest on muscles of a predetermined compressed range of said limb and said tight fitting band being fastened with said fastening means to have a desired size, a predetermined pressure to said limb around which said tight fitting band is wrapped, the pressure being produced by introducing air to said tube, said tight fitting band having a limiter plate therein, the limiter plate being limiting the direction towards which said tube is allowed to inflate as said tube is filled with air, to against the muscles as determined with said tight fitting band being rest on the muscles, said limiter plate being adapted to flexibly move in a curve by means of a series of segmented components joined to each other along the length of said tight fitting band.

The aforementioned muscle development device uses a limiter plate of a single plate-like object whereas this muscle development device uses a limiter plate made up of a series of segmented components.

According to this muscle development device, the limiter plate is made up of a series of segmented components joined to each other along the length of said tight fitting band. The adjacent segmented components can be angled with respect to each other. Thus, it can more easily hold the complex up-and-down surface of muscles in closer contact with it than the limiter plate of a mere plate-like object can do.

Said limiter plate may be any of suitable ones as long as it is adapted to flexibly move in a curve by means of a series of segmented components joined to each other along the length of said tight fitting band.

For example, adjacent pairs of said segmented components of the limiter plate may overlap each other at their ends like roof tiles.

With the limiter plate configured as described above, the portion to be bent is doubled. The pressure can be applied more uniformly to the portion of the tube at the positions corresponding to the bents, as compared with a series of segmented componentss joined to each other at their ends. The tight fitting band can more easily hold the complex up-and-down surface of muscles in closer contact with it when it is rest on the muscles.

The series of segmented componentss forming the limiter plate may have any one of suitable shapes as long as the series of segmented components joined to each other can function as a limiter plate that limits the direction towards which the tube is allowed to inflate as the tube is filled with air, to against the muscles as determined with the tight fitting band being rest on the muscles. Each segmented component may have the same configuration or not.

For example, said segmented component may have a generally rectangular shape. With the limiter plate having the segmented components that overlap each other at their ends, each segmented component contacts in line with the tube along one side facing on the tube when rest on muscles. This generates a predetermined gap between the sides in contact with the tube of the adjacent segmented components. The portion between the sides is not limited in their motion by the limiter plate and can thus follow the complex up-and-down surface of the muscles in closer contact with the surface of the muscles.

The shape of said segmented component may be a shape obtained by means of two small segments of, for example, a rectangular shape in such a manner they are fixed to each other with their ends overlapped each other. As a result, the shape of the limiter plate having the segmented components with such a step is as a single plate-like object. That is, such a limiter plate has no projections on the surface thereof and does not take up much space when it is not wrapped around a predetermined range on a limb.

Each of said segmented components may be adapted to flexibly move in a curve by means of grooves provided in the surface of the segmented component against the tube in a direction not parallel to the lengthwise direction of said tight fitting band at a predetermined distance along the length of said tight fitting band.

The limiter plate having such a segmented component can be bent at the grooves. Thus, the limiter plate having the aforementioned configuration can restrict the tube when the tight fitting band is rest on muscles and can more easily hold the complex up-and-down surface of muscles in closer contact with it.

The grooves may be any of the suitable grooves as long as they are provided in a direction not parallel to the lengthwise direction of said tight fitting band at a predetermined distance along the length of said tight fitting band and have a size that allows said segmented component to bend in a flexible manner, as in the grooves in the aforementioned limiter plate.

The aforementioned invention of the grooves may be combined with the invention of said small segments. In such a case, the aforementioned grooves are provided in at least one of said small segments. Of course, the aforementioned grooves may be provided in all of said small segments.

BRIEF DESCRIPTION OF THE DRAWINGS

FIG. 2 is a cross-sectional view of the muscle development device according to the first embodiment of the present invention;

FIG. 3A is a view showing the inner surface of a limiter plate of the muscle development device according to the first embodiment of the present invention;

FIG. 3B is a cross-sectional view of the limiter plate of the muscle development device according to the first embodiment of the present invention;

FIG. 6 is a cross-sectional view of a predetermined compressed range on a limb in a case where the muscle development device according to the first embodiment of the present invention is wrapped around the compressed range;

FIG. 7A is a top view of a limiter plate of a muscle development device according to a second embodiment of the present invention;

FIG. 7B is a side view of the limiter plate of the muscle development device according to the second embodiment of the present invention;

BEST MODES FOR CARRYING OUT THE INVENTION

Figure 1:
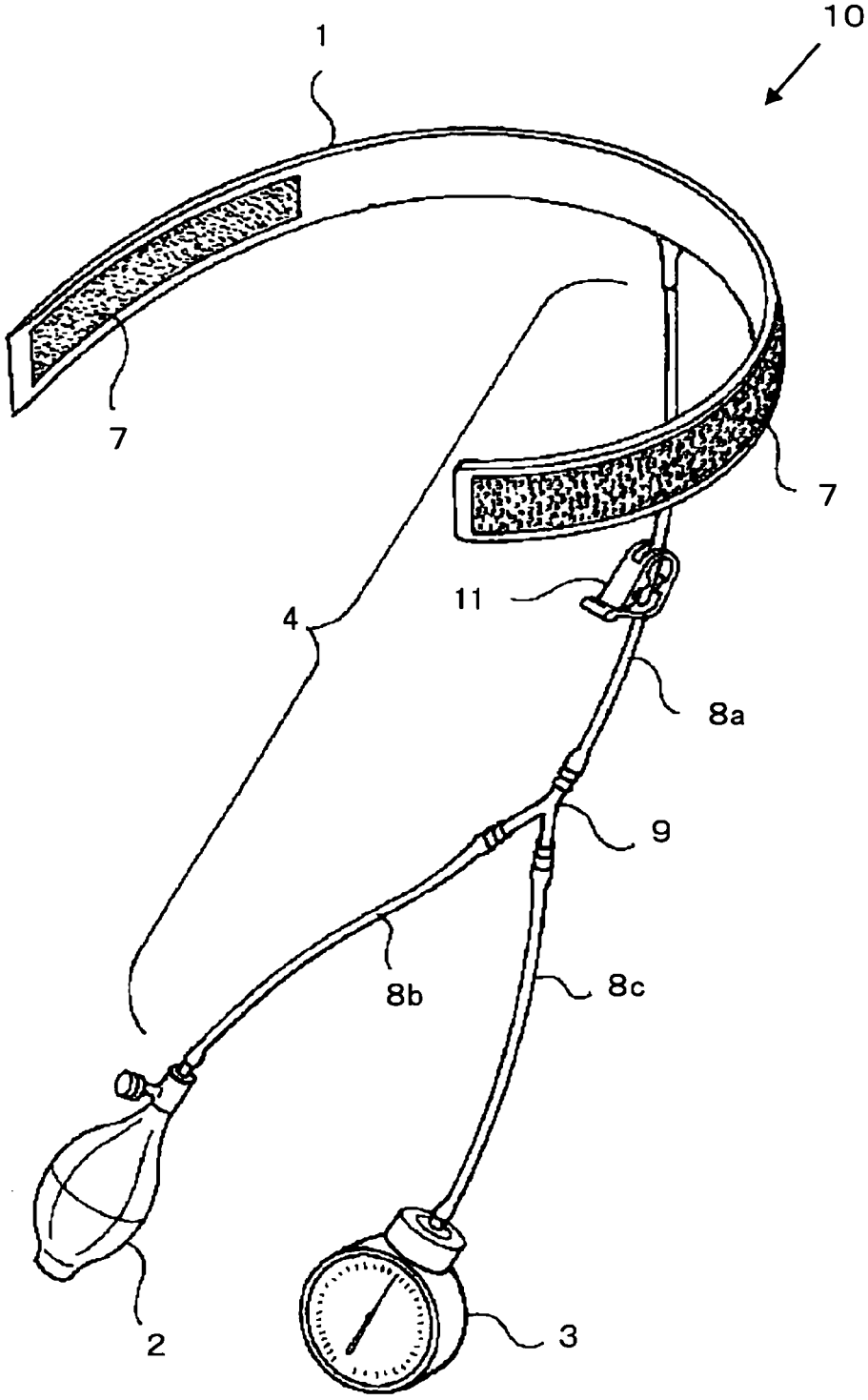
FIG. 1 is a view showing a muscle development device according to a first embodiment of the present invention in a state connected to a pump and an air pressure gauge through connecting means.

Referring to the drawings, embodiments of the present invention are described. In the following description of the embodiments, similar components and parts are depicted by the like reference numerals, and any redundant description will be omitted.

First Embodiment

FIG. 1 is a view showing a muscle development device 10 according to a first embodiment of the present invention in a state connected to a pump 2 and an air pressure gauge 3 through connecting means 4.

FIG. 2 is a cross-sectional view of the muscle development device 10 according to this embodiment in a case where the muscle development device 10 is wrapped around a predetermined compressed range on a limb.

The muscle development device 10 has a tight fitting band 1.

The tight fitting band 1 is made up of two pieces of heavy fabric having a width of on the order of 5 cm. These pieces are stitched together along the lengthwise edges to form a long hollow object having a space inside it.

The tight fitting band 1 has a tube 5 therein. The tube 5 in this embodiment is made of a rubber that can withstand a pneumatic pressure of on the order of 200 mmHg.

The tight fitting band 1 further has a limiter plate 6 therein along the outer surface of the tube 5.

The limiter plate 6 in this embodiment is a plate-like object as shown in FIG. 3A having a width of about 4 cm which is made of a polypropylene resin. Grooves 6*a* are formed in the surface of the limiter plate 6 against the tube 5 in a direction generally in parallel to the widthwise direction of the tight fitting band 1 at a predetermined distance (0.5 cm to 1.5 cm) along the length of the tight fitting band 1. Each groove 6*a* in this embodiment has a V-shape in cross-section as shown in FIG. 3B.

The grooves 6*a* in this embodiment are described as being provided generally parallel to the widthwise direction of the tight fitting band 1 but they are not limited thereto. The only requirements are that the grooves 6*a* are provided in the surface of the limiter plate 6 against the tube 5 in a direction not parallel to the lengthwise direction of the tight fitting band 1 at a predetermined distance along the length of the tight fitting band 1 and that the grooves 6*a* allow the limiter plate 6 to bend in a flexible manner.

The reference numeral 7 represents a length of Velcro tape that serves as the fastening means.

The reference numerals 8*a* through 8*c* represent connecting pipes constituting the connecting means 4. More specifically, they are connecting pipes that are connected to the tube 5 within the tight fitting band 1, the pump 2, and the air pressure gauge 3, respectively. The connecting pipes 8*a*, 8*b*, and 8*c* are each a rubber-made hollow object. The reference numeral 9 represents a connection member that provides connection among the connecting pipes 8*a*, 8*b*, and 8*c*. It is a hollow Y-joint.

The reference numeral 11 represents a pinch clip 11 that is used to maintain the air pressure within the tube 5 by squeezing the connecting pipe 8*a* with it.

Figure 4:
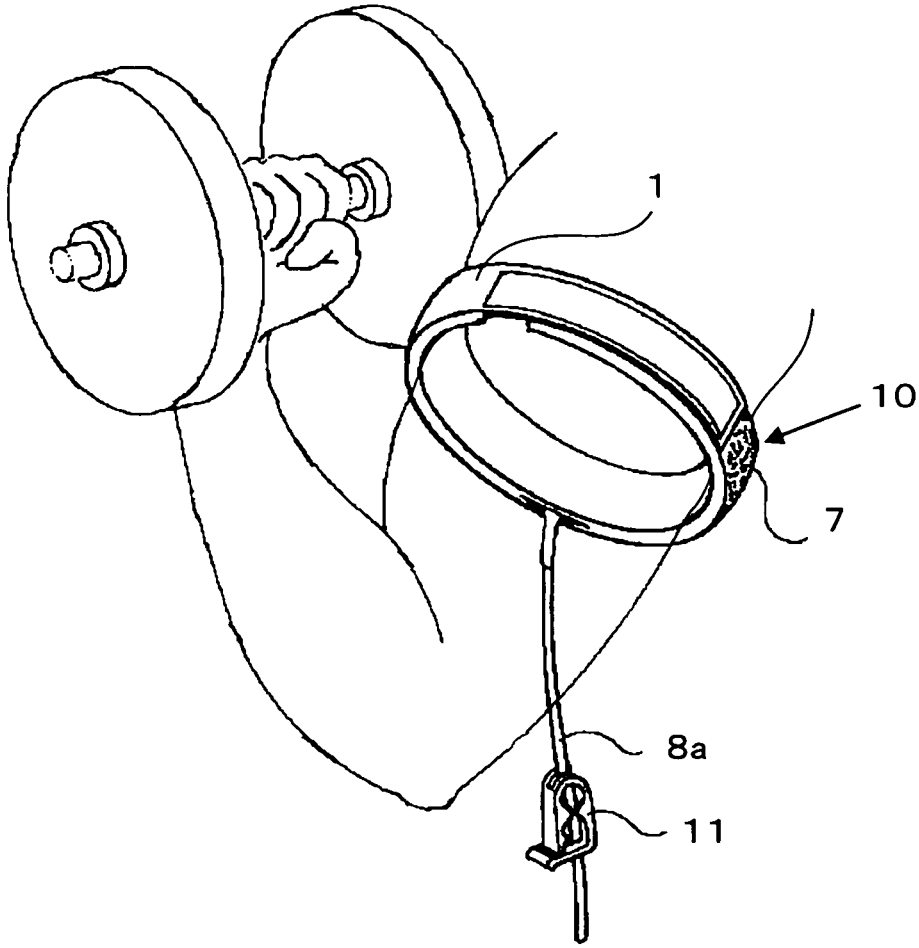
FIG. 4 is a perspective view illustrating the use of the muscle development device according to the first embodiment of the present invention.

Next, how the muscle development device 10 is used is described with reference to FIG. 4.

For the muscle development with the muscle development device 10 according to the present invention, the tight fitting band 1 is put around a proximal region of the muscles that you want to develop. FIG. 4 shows an example where the biceps brachii is the target muscles for development. The tight fitting band 1 is rest on the biceps brachii at a position closer to the heart.

Next, the tight fitting band 1 is fastened with the fastening means 7 to prevent the size of the loop of the tight fitting band 1 from being changed.

A gap between the arm and the tight fitting band 1, if present, upsets the relationship between the air pressure applied to the tube 5 within the tight fitting band 1 and the compression force produced by the tight fitting band 1. Thus, the tight fitting band 1 should be closely fitted to the arm without any gap.

Then, the pump 2 is used to force the air into the tube 5. The air is introduced until the pressure reaches an appropriate level while monitoring the air pressure within the tube 5 using the air pressure gauge 3.

The tube 5 being filled with the air inflates entirely, i.e., inwardly as well as outwardly. It is, however, pushed back by the limiter plate 6 that are provided outside the tube 5. Consequently, the direction towards which the tube 5 is allowed to inflate is limited to inward, as shown in FIG. 2. This brings about the application of a proper pressure to a predetermined compressed range on the limb.

In addition, the muscle development device 10 according to this embodiment uses the limiter plate 6 having the grooves 6*a* as the means to limit the direction towards which the tube 5 is allowed to inflate, to inward, when the tube 5 is being filled with air.

Figure 5:
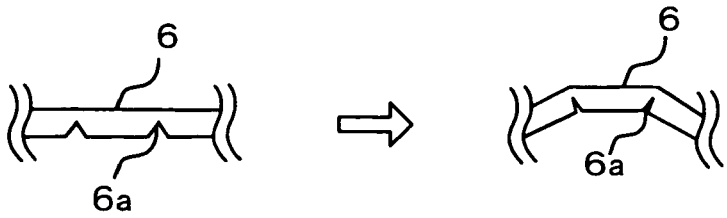
FIG. 5 is a view showing the limiter plate of the muscle development device according to the first embodiment of the present invention in which the limiter plate is shown curved.

The limiter plate 6 can be bent at grooves 6*a* as shown in FIG. 5. It can follow a complex up-and-down surface of the muscles to hold the tube 5 firmly. Therefore, as shown in FIG. 6, the tight fitting band 1 can follow and hold a complex up-and-down surface of the muscles in close contact with it in a flexible manner. When a user does exercises with the tight fitting band 1 being rest on his or her muscles, the tight fitting band 1 can more easily hold the surface of complex moving muscles in closer contact with it than a tight fitting band wiht a simple plate-like object can do. The internal pressure within the tube 5 can be kept constant and a sufficient pressure can be applied to every part even under the influence of muscle movements.

After the internal pressure within the tube 5 reaches an appropriate level, the user may either keep rest for a while or do exercises using the muscles that he or she wants to develop in order to put a stress on the muscles. It is obvious that exercises provide a much better muscle development effect, but it has been found that a muscle development effect can be obtained even when the user keeps rest without any exercises.

With some exercises of the muscles, the connecting pipe 8*a* is closed with the pinch clip 11 to prevent the air from escaping from the tube 5 before the connecting pipe 8*a* is separated from the connection member 9. This is illustrated in FIG. 4.

In this embodiment, the air is described as being forced manually into the tube 5 by using the pump 2 but it is not limited thereto. The air may be introduced automatically to a desired pressure level by using a suitable device or machine such as an automatic air supply device.

Second Embodiment

Figure 8A:
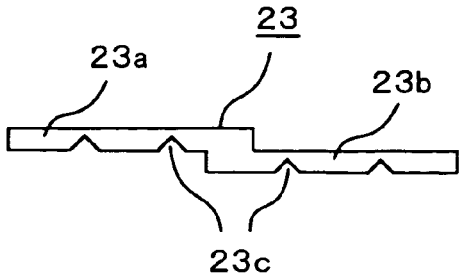
FIG. 8A is a view showing a segmented component that constitutes a part of the limiter plate of the muscle development device according to the second embodiment of the present invention.

Next, a muscle development device according to a second embodiment of the present invention is described with reference to FIGS. 7 through 9. A muscle development device 20 in this embodiment is basically similar to the aforementioned muscle development device 10 in the first embodiment except for the configuration of a limiter plate.

FIGS. 7A and 7B are views showing a limiter plate 22 used in a muscle development device 20 according to this embodiment.

The limiter plate 22 used in the muscle development device 20 according to this embodiment is made up of a series of segmented components 23 joined to each other, rather than a single plate-like object as in the first embodiment.

More specifically, the limiter plate 22 according to this embodiment is made up of a series of segmented components 23 which are joined to each other along the length of the tight fitting band 1 in such a manner that the adjacent segmented components 23 overlap each other at their ends, as shown in FIGS. 7A and 7B, enabling flexible curve to be made.

Figure 8B:
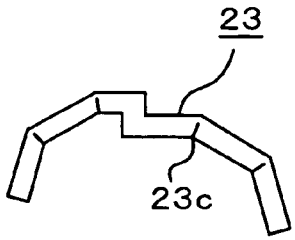
FIG. 8B is a view showing a segmented component, which constitutes a part of the limiter plate of the muscle development device according to the second embodiment of the present invention in which the segmented component is shown curved.

The segmented component 23 in this embodiment has a step- or stair-like shape with two small rectangular segments 23*a* and 23*b* connected to each other at their ends in such a manner that small regions parallel to rectangular segments 23*a* and 23*b* short sides overlap each other as shown in FIG. 7B, but not limited thereto. The small segments 23*a* and 23*b* in this embodiment has the surface against the tube 5 in which two grooves 23*c* of a V-shape in cross section are formed in a direction generally parallel to the widthwise direction of the tight fitting band 1 along the length of the tight fitting band 1, as shown in FIG. 8B.

In this embodiment, the overlapped portions, more specifically, approximate centers of the overlapped portions of the respective small segments 23*a* and 23*b* are sewn on each other generally parallel to the widthwise direction of the tight fitting band 1 to connect the adjacent small segments 23*a* and 23*b*.

The limiter plate 22 having the aforementioned configuration can, as a whole, flexibly move in a curve as shown in FIG.

8B with the angle between the adjacent segmented components 23 being varied and the segmented component 23 being allowed to bent at the grooves 23*c*, as in the first embodiment.

Figure 9:
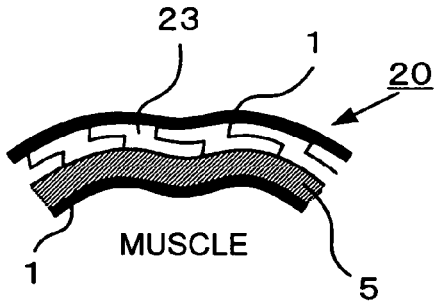
FIG. 9 is a cross-sectional view of a predetermined compressed range on a limb in a case where the muscle development device according to the second embodiment of the present invention is wrapped around the compressed range.
Figure 10:
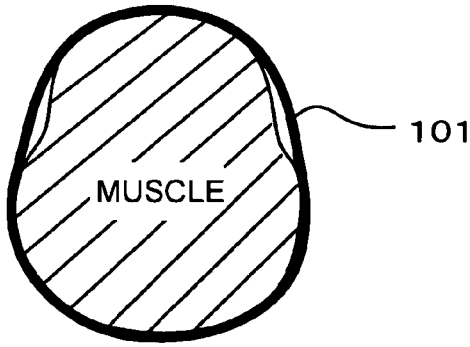
FIG. 10 is a cross-sectional view of a predetermined compressed range on a limb in a case where the muscle development device having a flat piece, which is a single plate-like object, is wrapped around the compressed range.

Thus, when the muscle development device 20 having the limiter plate 22 of the type described is wrapped around a predetermined compressed range on a limb, the tight fitting band 1 can hold a complex up-and-down surface of the muscles in closer contact with it as shown in FIG. 9 than a tight fitting band with the limiter plate of a mere plate-like object can do. Therefore, this provides similar effects to those obtained with the muscle development device in the first embodiment.

Although the limiter plate 22 in this embodiment is as described above, the limiter plate may be any of suitable ones as long as a series of segmented components are joined to each other along the length of the tight fitting band to provide flexible motion thereof.

The invention claimed is:

1. A muscle development device comprising:

a hollow tight fitting band having a tube therein; and fastening means keeping a length of the tight fitting band in a loop having a desired size, the muscle development device being used to develop muscles of a limb while restricting the blood flow therethrough by means of applying, with said tight fitting band being rest on muscles of a predetermined compressed range of said limb and said tight fitting band being fastened with said fastening means to have a desired size, a predetermined pressure to said limb around which said tight fitting band is wrapped, the pressure being produced by introducing air to said tube, said tight fitting band having a limiter plate therein, the limiter plate being limiting the direction towards which said tube is allowed to inflate as said tube is filled with air, to against the muscles as determined with said tight fitting band being rest on the muscles, said limiter plate being adapted to flexibly move in a curve by means of a series of segmented components joined to each other along the length of said tight fitting band.

2. The muscle development device as claimed in claim 1, wherein said limiter plate is configured with adjacent pairs of said segmented components overlapping each other at their ends.

3. The muscle development device as claimed in claim 2 wherein said, shape of said segmented components is a shape with two small segments connected to each other in such a manner that their ends overlap each other.

4. The muscle development device as claimed in claim 3 wherein each, small segment comprises two grooves, the grooves extending in a direction not parallel to the lengthwise direction of said tight fitting band at a predetermined distance along the length of said tight fitting band.

5. The muscle development device as claimed in claim 1, wherein each of said segmented components being adapted to flexibly move in a curve by means of grooves provided in the surface of said segmented component against said tube in a direction not parallel to the lengthwise direction of said tight fitting band at a predetermined distance along the length of said tight fitting hand.

6. The muscle development device as claimed in claim 5, wherein each of said segmented components comprises a first extending portion, a second extending portion, and an overlapping portion in which the first extending portion overlaps the second extending portion, and wherein grooves are provided in a surface of the segmented component that faces the tube.

7. The muscle development device as claimed in claim 6, wherein each segmented component comprises two grooves that face the tube in each of the first extending portion and the second extending portion.

8. The muscle development device as claimed in claim 7, wherein adjacent segmented components are attached to each other by joining respective extending portions at an approximate center of each of the extending portions.

9. The muscle development device as claimed in claim 8, wherein the extending portions of adjacent segmented components are sewn to each other in a direction generally parallel to the widthwise direction of the tight fitting band.

10. The muscle development device as claimed in claim 1, wherein the segmented components abut each other such that there is no space between adjacent pairs of segmented components.

11. The muscle development device as claimed in claim 1, wherein the limiter plate is configured to flexibly move in a curve such that it flexes in two directions.

12. The muscle development device as claimed in claim 1, wherein the limiter plate is configured to flex in a widthwise direction around a radial curvature of the tube.

13. A muscle development device comprising:

a hollow tight fitting band having a tube therein; and fastening means keeping a length of the tight fitting band in a loop having a desired size, the muscle development device being used to develop muscles of a limb while restricting the blood flow therethrough by means of applying, with said tight fitting band being rest on muscles of a predetermined compressed range of said limb and said tight fitting band being fastened with said fastening means to have a desired size, a predetermined pressure to said limb around which said tight fitting band is wrapped, the pressure being produced by introducing air to said tube, said tight fitting band having a limiter plate therein, the limiter plate limiting the direction towards which said tube is allowed to inflate as said tube is filled with air, to against the muscles as determined with said tight fitting band being rest on the muscles, said limiter plate being adapted to flexibly move in a curve by means of grooves provided in the surface thereof against said tube in a direction not parallel to the lengthwise direction of said tight fitting band at a predetermined distance along the length of said tight fitting band.

14. A muscle development device comprising:

a hollow tight fitting band having a tube herein; and fastening means keeping a length of the tight fitting band in a loop having a desired size, the muscle development device being used to develop muscles of a limb while restricting the blood flow therethrough by means of applying, with said tight fitting band being rest on muscles of a predetermined compressed range of said limb and said tight fitting band being fastened with said fastening means to have a desired size, a predetermined pressure to said limb around which said tight fitting band is wrapped, the pressure being produced by introducing air to said tube, said tight fitting band having a limiter plate therein, the limiter plate limiting the direction towards which said tube is allowed to inflate as said tube is filled with air, to against the muscles with said tight fitting band resting on the muscles, said limiter plate being adapted to flexibly move in a curve by means of a series of segmented components joined to each other along the length of said tight fitting band, wherein each segmented component comprises an upper segment and a lower segment, each of the upper segments having two grooves and each of the lower segments having two grooves, each of the grooves being provided on surfaces of the segments that face the tube and extending in a direction not parallel to the lengthwise direction of said tight fitting band at a predetermined distance along the length of said tight fitting band.

* * * * *